US010994976B2

(12) United States Patent
Caffa et al.

(10) Patent No.: US 10,994,976 B2
(45) Date of Patent: May 4, 2021

(54) SELF-ADJUSTING CAPPING CHUCK FOR APPLYING THE CLOSURE ELEMENTS ON CONTAINERS

(71) Applicant: AROL S.P.A., Canelli (IT)

(72) Inventors: Marco Caffa, Cortemilia (IT); Marco Cipriani, Alpignano (IT)

(73) Assignee: AROL S.P.A., Canelli (IT)

( * ) Notice: Subject to any disclaimer, the term of this patent is extended or adjusted under 35 U.S.C. 154(b) by 175 days.

(21) Appl. No.: 16/324,559

(22) PCT Filed: Aug. 8, 2017

(86) PCT No.: PCT/IB2017/054833
§ 371 (c)(1),
(2) Date: Feb. 10, 2019

(87) PCT Pub. No.: WO2018/033826
PCT Pub. Date: Feb. 22, 2018

(65) Prior Publication Data

US 2019/0177145 A1 Jun. 13, 2019

(30) Foreign Application Priority Data

Aug. 17, 2016 (IT) ..... 102016000085761

(51) Int. Cl.
*B67B 3/20* (2006.01)

(52) U.S. Cl.
CPC ..... *B67B 3/2066* (2013.01)

(58) Field of Classification Search
CPC ..... B67B 3/20; B67B 3/2066; B67B 3/2073
USPC ..... 53/317, 331.5
See application file for complete search history.

(56) References Cited

U.S. PATENT DOCUMENTS 1,249,025 A * 12/1917 Carvalho ..... B67B 7/182 81/3.2
3,303,633 A * 2/1967 Wilhere ..... B67B 3/2073 53/306
4,178,733 A * 12/1979 Dankert ..... B67B 3/2073 53/331.5

(Continued)

FOREIGN PATENT DOCUMENTS

CN 2387095 Y 7/2000
CN 104058355 A 9/2014

(Continued)

*Primary Examiner* — Stephen F. Gerrity
(74) *Attorney, Agent, or Firm* — Howson & Howson LLP

(57) ABSTRACT

A self-adjusting capping chuck includes a support having a longitudinal axis, a guide element fixed with respect to the support and having guides, jaws which engage respective guides and are movable with respect to the support between release and gripping positions, the jaws have respective gripping surfaces and first cam surfaces, and a control ring movable relative to the support along the longitudinal axis between lowered and raised positions and having second cam surfaces cooperating with first cam surfaces of the jaws, so that the movement of the control ring from the lowered to the raised position moves the jaws from the release to the gripping position. The control ring has an abutment wall arranged to abut on a head surface of a closure element so that, during movement of the chuck along the longitudinal axis, the closing element moves the control ring from the lowered to the raised position.

10 Claims, 6 Drawing Sheets

(56) References Cited

U.S. PATENT DOCUMENTS

| | | | | | |
|---|---|---|---|---|---|
| 4,674,263 | A * | 6/1987 | Kelly | B67B 3/2066 | 53/317 |
| 4,745,729 | A | 5/1988 | Bethg et al. | | |
| 4,905,447 | A * | 3/1990 | Margaria | B67B 3/2066 | 53/317 |
| 5,054,260 | A * | 10/1991 | Herzog | B67B 3/2073 | 53/307 |
| 5,327,697 | A * | 7/1994 | Kent | B67B 3/2073 | 53/331.5 |
| 6,044,626 | A * | 4/2000 | Harper et al. | B67B 3/2066 | 53/317 |
| 7,131,245 | B2 | 11/2006 | Joerg et al. | | |
| 7,322,165 | B2 | 1/2008 | Spether | | |
| 8,631,630 | B2 * | 1/2014 | Naaber | B67B 3/2066 | 53/329 |
| 9,388,031 | B2 | 7/2016 | Schoenfelder | | |
| 9,845,230 | B2 | 12/2017 | Groninger et al. | | |
| 2003/0196519 | A1 * | 10/2003 | Graffin | B67B 3/2073 | 81/3.2 |
| 2008/0028892 | A1 | 2/2008 | Cirio | | |
| 2014/0311089 | A1 | 10/2014 | Scott et al. | | |

FOREIGN PATENT DOCUMENTS

| | | | | |
|---|---|---|---|---|
| DE | 3416551 | A1 * | 11/1985 | B67B 3/2066 |
| DE | 3912324 | A1 * | 10/1990 | B67B 3/2073 |
| DE | 102004048782 | A1 * | 4/2006 | B67B 3/2066 |
| EP | 2301885 | B1 * | 7/2014 | B67B 3/2066 |
| WO | 2008/043489 | A1 | 4/2008 | |

* cited by examiner

II
22
18
A
16
10
20
28
24
26
34
32
30
36
40
44
42
III
38
46
48
52
50
14
12
C

SELF-ADJUSTING CAPPING CHUCK FOR APPLYING THE CLOSURE ELEMENTS ON CONTAINERS

FIELD OF THE INVENTION

The present invention generally relates to apparatuses for closing containers and concerns a self-adjusting capping chuck for applying closure elements on containers.

The present invention has been especially developed for screwing threaded caps on containers, but it is not limited to that specific field of use. Indeed, the invention can be used whenever generic closure elements, such as press-fitted tops or caps, are to be applied on containers. The invention also applies to closure elements with pump-operated dispensers, whether or not they are equipped with a dip stock, or with pushbutton-operated or trigger-operated proportioners, etc.

DESCRIPTION OF THE RELATED ART

Apparatuses for applying closure elements on containers generally include a carousel structure with a plurality of capping heads, each having a piston movable along a longitudinal axis. In case of apparatuses for applying threaded caps, the piston is actuated according to a screwing movement along the longitudinal axis. Each capping head has a capping chuck fastened to the bottom end of the respective piston. The capping chucks are provided with jaws capable of gripping the caps or other closure elements with a force allowing applying the screwing torque or the insertion force.

Closure elements used for closing containers often have different physical and geometrical features. The closure elements may have any shape (circular, oval, polygonal, conical etc.) and may be equipped or not equipped with a dip stock, a pump for proportioning the product, levers or systems for actuating the product proportioning pump (triggers, levers, pushbuttons, etc.).

The closure elements may be supplied by different manufacturers and may be made of different materials and according to different production processes. Thus, it frequently happens that the closure elements have different dimensional tolerances and geometrical deformations of various kinds with respect to the theoretical shape.

Taking the variability of the geometrical and dimensional characteristics of the closure elements into account, the need arises to provide self-adjusting capping chucks, which are capable of gripping and applying (screwing, press-fitting and/or inserting) closure elements with different characteristics with the required application torque/force. In case of threaded caps, a particularly important requirement is that the capping chucks are capable of applying the screwing torque without damaging the caps.

US 2014/0311089 discloses a capping chuck including a plurality of jaws pressed by an elastic ring keeping the jaws in a rest condition in the position of minimum gripping diameter. During cap gripping, the caps are to be inserted into the chuck while the jaws are being elastically pressed inwards by overcoming the resistance of the elastic ring elastically pressing the jaws inwards. At the end of the screwing, while the jaws are being disengaged from the cap, the gripping surfaces of the jaws rotate onto the knurled surface of the caps while being elastically pressed inwards. A solution of this kind entails therefore high risks of damaging the caps.

U.S. Pat. No. 7,131,245 discloses a self-adjusting capping chuck including a plurality of jaws hingedly connected to a support about respective pins. Each jaw is associated with a spring biasing the respective jaw towards a position in which the jaw is in contact with the cap. The load generated by the springs must be very high in order to ensure torque transmission during the screwing phase. At the end of the screwing, when the capping chuck is raised from the container, the toothed portions of the jaws come in contact with the knurling of the cap while the chuck is being raised from the container according to a rotary-translatory movement and tend to damage the knurling of the caps. During the cap gripping phase, the jaws, because of the action of the springs, take the minimum diameter configuration and cap gripping must take place by compressing the elastic members of the jaws in order the cap can be accommodated inside the chuck. Since the elastic force acting on the jaws is very high, the caps can be damaged also during the picking phase.

U.S. Pat. No. 7,322,165 discloses a self-adjusting capping chuck including a plurality of jaws having respective gripping surfaces and respective cam surfaces cooperating with an inclined surface of the support, so that the jaws are compressed inwards during the screwing phase. The jaws cooperate with springs tending to bias the jaws towards an open position. When the chuck is raised from the container, the jaws come into contact with the external knurling of the caps while the chuck rotates and is raised from the container. During such a phase, the risk of damaging the external knurling of the caps exists. Another drawback of this solution is that the springs tending to bias the jaws towards the release position do not allow an accurate washing of the chuck and give rise to areas where water stagnates.

OBJECT AND SYNTHESIS OF THE INVENTION

It is an object of the present invention to provide a self-adjusting capping chuck overcoming the problems of the prior art.

More specifically, it is an object of the invention to provide a capping chuck capable of picking up and applying closure elements without risks of damaging them.

According to the invention the above objects are achieved by a self-adjusting capping chuck having the features set forth in embodiments disclosed herein.

The claims are integral part of the technical teaching provided herein in respect of the invention.

As it will become apparent from the following description, one of the features of the chuck according to the present invention is that the closure is controlled through an axial vertical load and the closure force is independent of the rotary and torsional components. This feature allows dividing the forces acting onto the chuck, thereby preventing the torsional components from damaging the cap during all application phases.

BRIEF DESCRIPTION OF THE DRAWINGS

The invention will now be described in detail with reference to the accompanying drawings, given merely by way of non-limiting example, in which.

DETAILED DESCRIPTION

Figure 1:
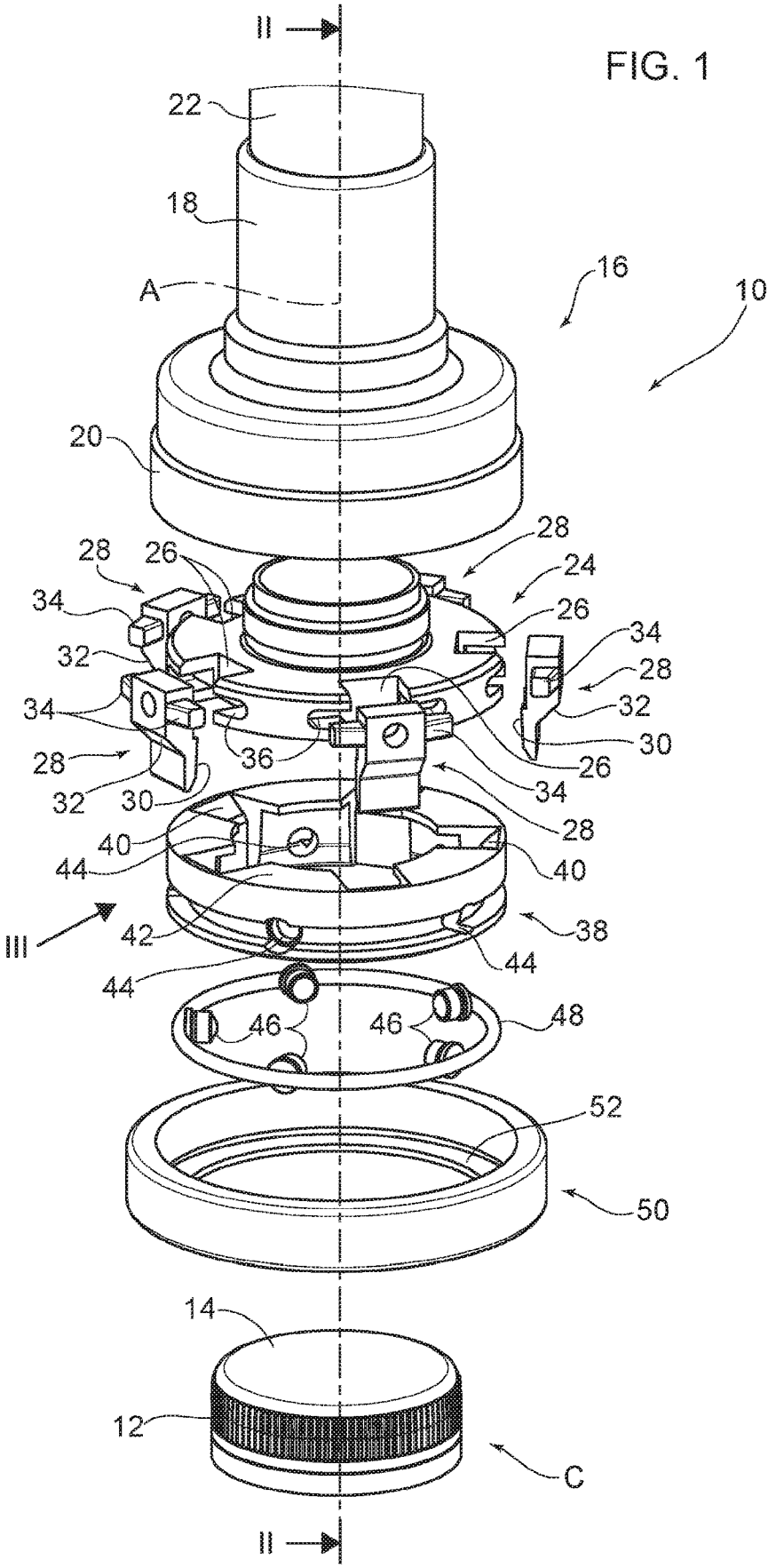
FIG. 1 is an exploded perspective view of a self-adjusting capping chuck according to the present invention.
Figure 2:
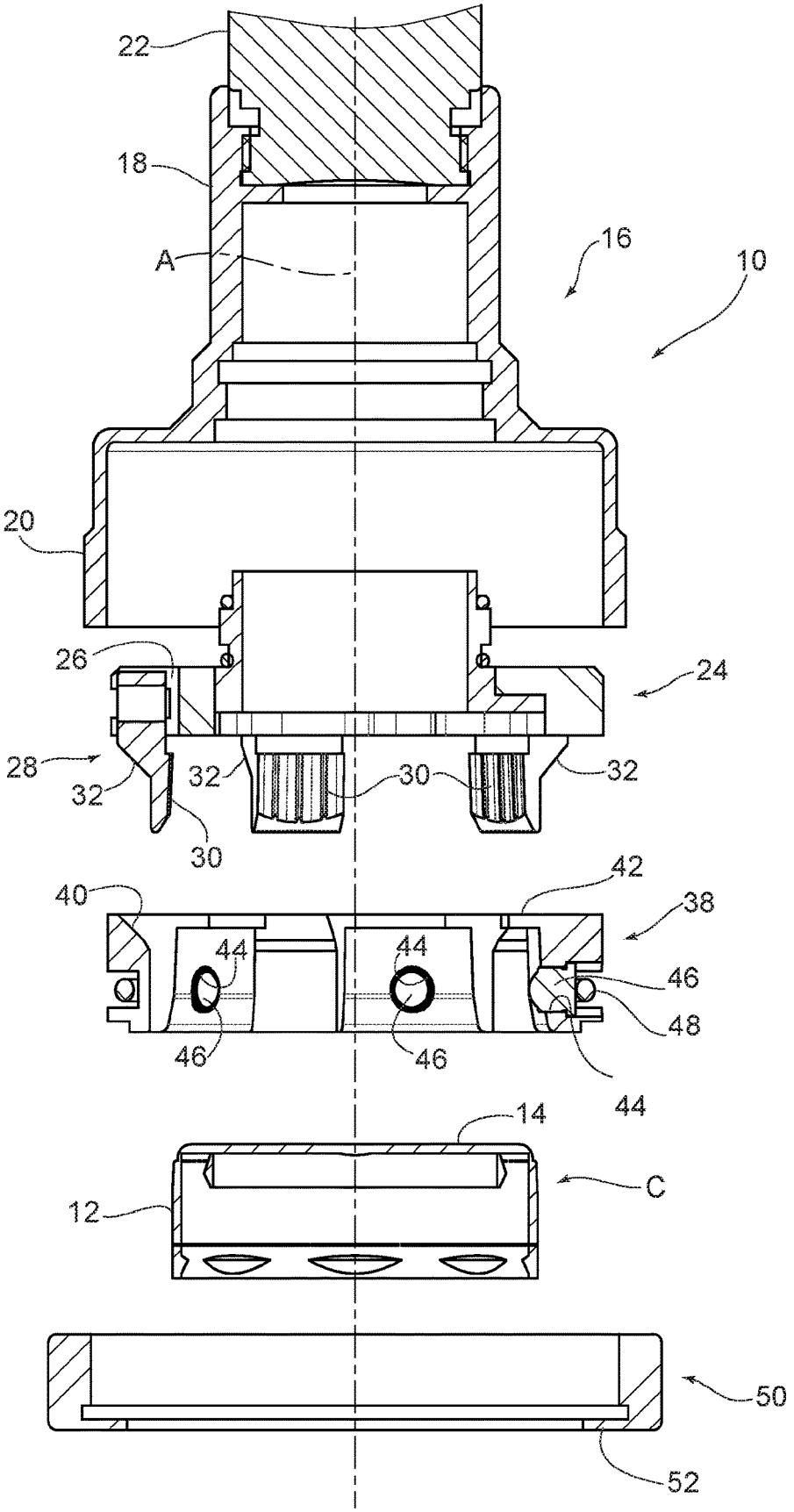
FIG. 2 is an exploded sectional view taken along line II-II in FIG. 1.
Figure 3:
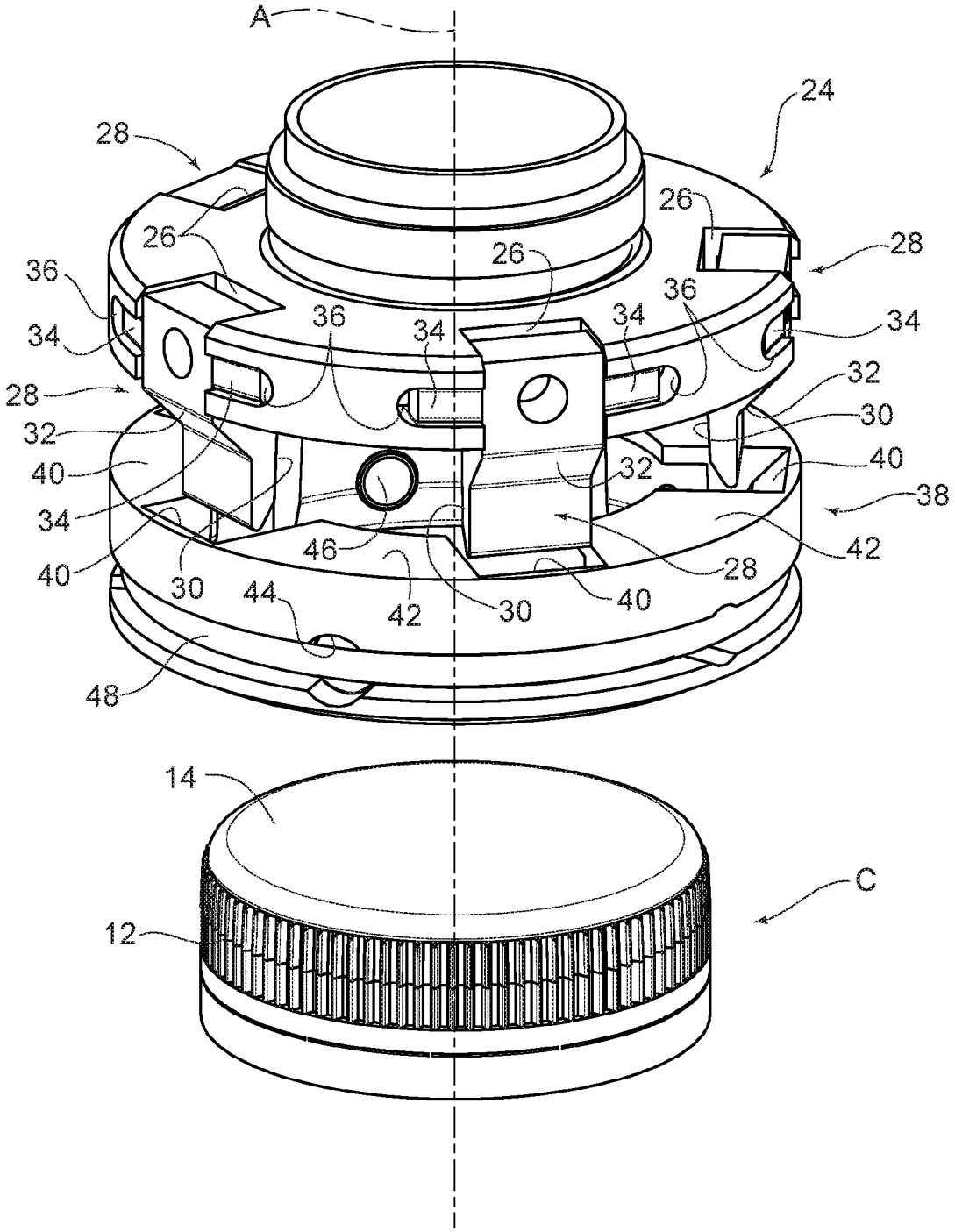
FIG. 3 is a perspective view of the portion pointed to by arrow III in FIG. 1

The following description is made with specific reference to the case of threaded caps that are applied on respective threaded containers by means of a screwing movement. Yet, the invention is not to be intended as being limited to such a specific example. As stated before, the invention can be used in general for applying closure elements of any kind, by screwing or press-fitting. In case of screwed tops, the chuck will undergo a rotary movement combined with a movement in longitudinal direction, whereas in case of press-fitted tops the chuck will move in longitudinal direction only.

Referring to the drawings, reference numeral 10 denotes a self-adjusting capping chuck for screwing caps C on containers. Caps C have an outer side wall 12, a head surface 14 and an inner thread that is intended for being screwed onto the outer thread of a container, such as for instance a bottle. Outer surface 12 could be provided with a knurling, as shown in the drawings, or it could be smooth or provided with any other kind of finish.

Capping chuck 10 includes a support 16 having a stem 18 and a cup-shaped portion 20 open downwards. Support 16 has a longitudinal axis A and is intended to be fastened to the bottom end of a piston 22 of a capping head (not shown), transmitting a screwing movement along axis A to support 16.

Capping chuck 10 includes a guide element 24 fixed with respect to support 16 and having a plurality of guides 26. In the example illustrated in the drawing, guide element 24 is an element separate from support 16 and it is secured to the support for instance by press-fitting. In the alternative, guide element 24 could be integrally formed with support 16. In the example illustrated herein, guides 26 are U-shaped recesses radially oriented relative to axis A.

Chuck 10 includes a plurality of jaws 28 engaging respective guides 26 in guide element 24. Jaws 28 are movable independently of one another in respective guides 26 in radial directions relative to axis A between a release position and a gripping position. Jaws 28 have respective gripping surfaces 30 arranged to engage outer surface 12 of caps C. For instance, gripping surfaces 30 may be toothed or covered with rubber and may have a curvature corresponding to the radius of side wall 12 of caps C. Jaws 28 have respective first cam surfaces 32 turned outwards. In the example illustrated herein, the first cam surfaces 32 are plane surfaces inclined relative to axis A. In the example illustrated herein, jaws 28 are provided with respective pins 34 engaging respective tangential recesses 36 in guide element 24, so that jaws 28 are constrained with respect to guide element 24 in the direction of longitudinal axis A.

Figure 4:
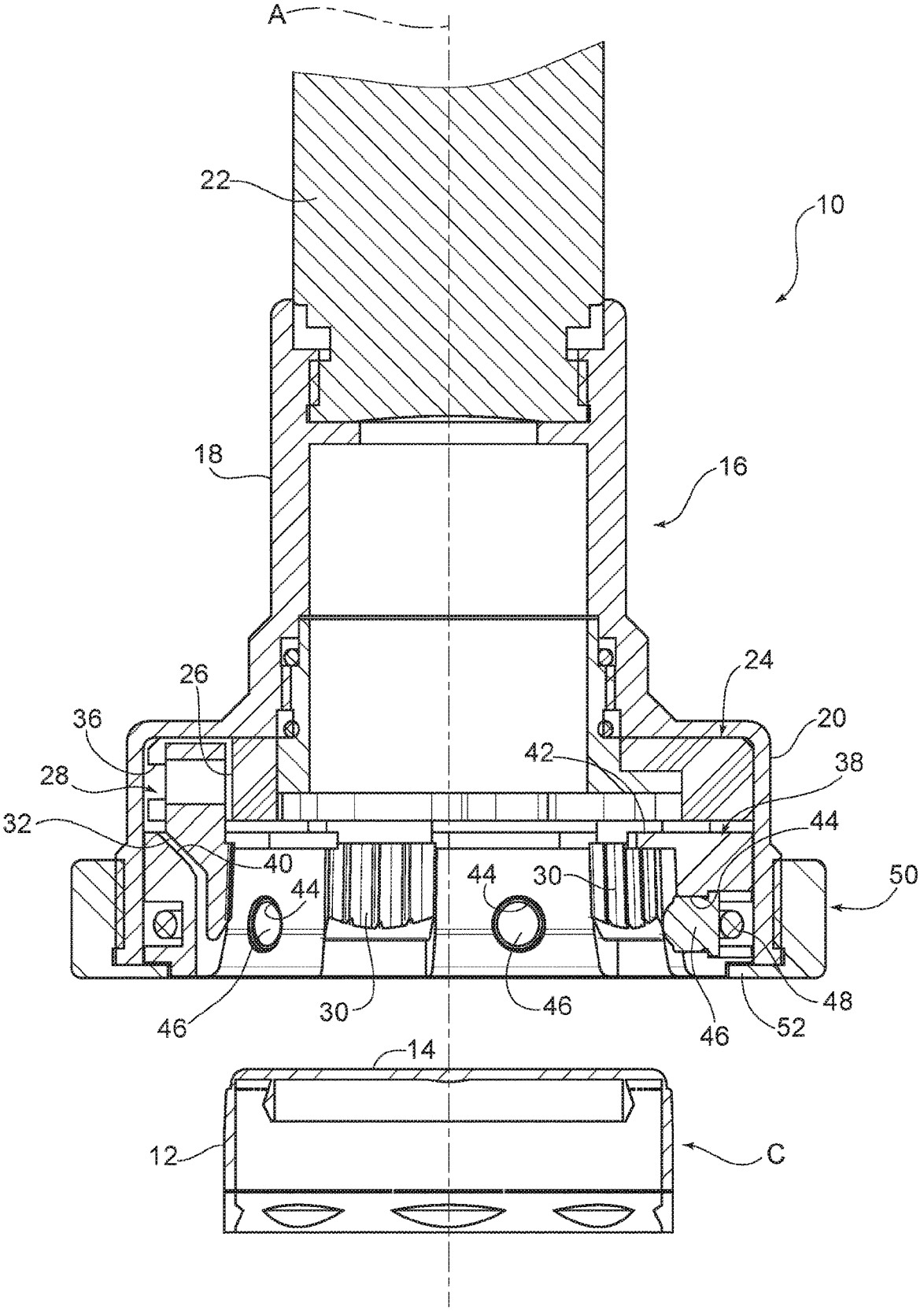
FIGS. 4 and 5 are axial sectional views of the capping chuck according to the present invention in release position and in gripping position, respectively.
Figure 5:
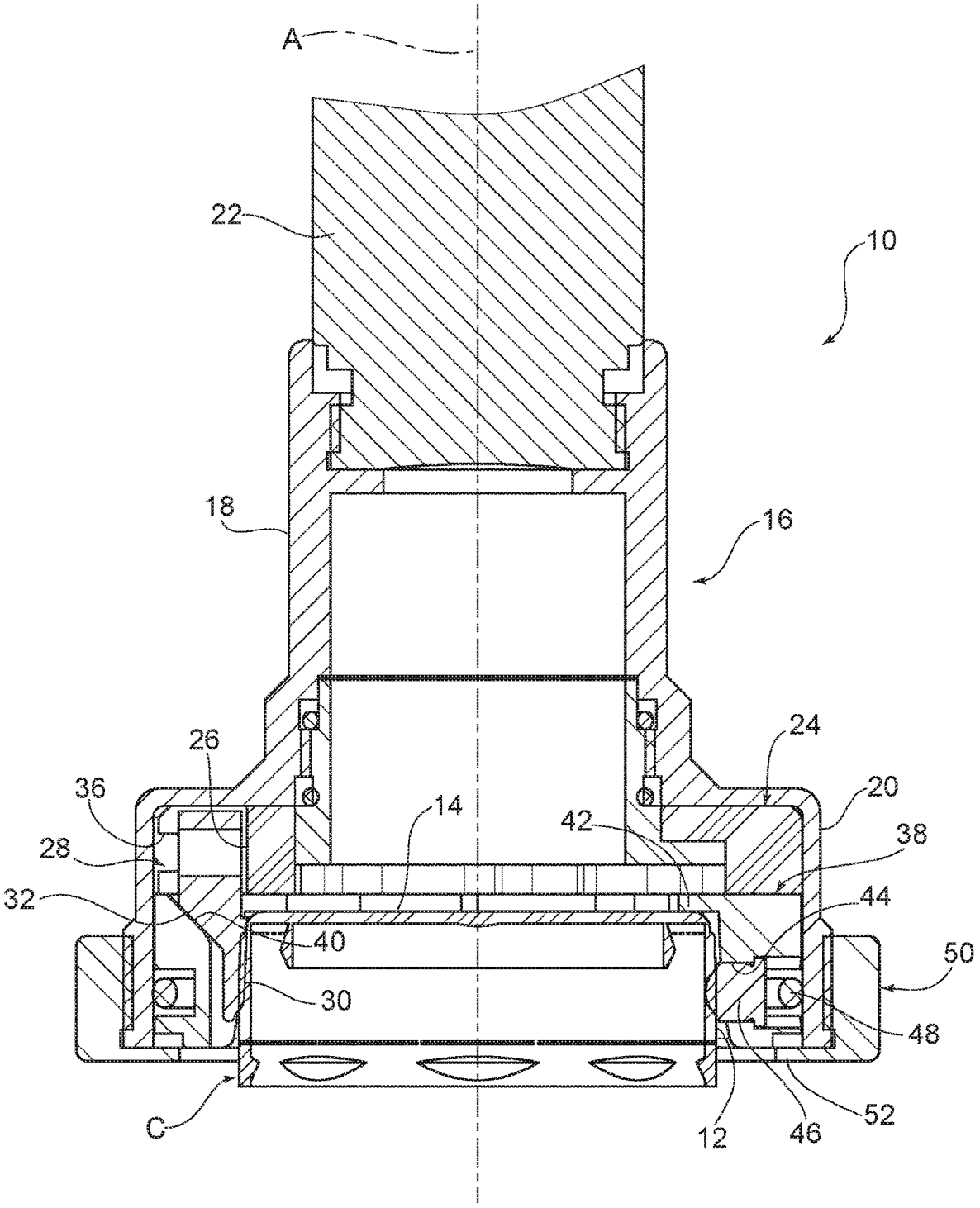

Chuck 10 includes a control ring 38 movable relative to support 16 along axis A between a lowered position (FIG. 4) and a raised position (FIG. 5). Control ring 38 has a plurality of second cam surfaces 40 cooperating with respective first cam surfaces 32 of jaws 28. In the example illustrated herein, the second cam surfaces 40 are plane surfaces inclined relative to axis A and having the same inclination as the first cam surfaces 32 of jaws 28. The first and second cam surfaces 32, 40 are so arranged that the movement of control ring 38 from the lowered position to the raised position radially moves jaws 28 inwards from the release position to the gripping position. Control ring 38 has an abutment wall 42 that is intended for abutting on head surface 14 of a cap C inserted into chuck 10. In the example illustrated herein, abutment wall 42 is a radial wall having interruptions in correspondence of the second cam surfaces 40. Control ring 38 has a plurality of holes 44, each located between two second cam surfaces 40. Holes 44 receive respective retaining elements 46 shaped as pins or balls and partially projecting from the inner side surface of control ring 38. An elastic ring 48, consisting e.g. of an O-ring, elastically biases retaining elements 46 inwards in radial direction.

Capping chuck 10 further includes a closing ring 50 secured to the bottom end of cup-shaped portion 20 of support 16 and having a radial edge 52 onto which control ring 38 abuts in its lowered position.

In the cap picking position, capping chuck 10 is in the configuration shown in FIG. 4. In such a position, control ring 38 is in its lowered position and abuts on radial edge 52 of closing ring 50. Jaws 18 are freely movable in radial direction along respective guides 36. Under such a condition, capping chuck 10 is lowered on a cap C according to an up-down vertical movement. During such a movement, cap C is inserted into control ring 38. The side walls of cap C interfere with retaining elements 46 projecting from the inner surface of control ring 38. Cap C is retained inside chuck 10 by retaining elements 46 elastically pressed against side wall 12 of cap C.

During insertion of cap C into control ring 38, jaws 28 are freely movable outwards in radial direction, so that gripping surfaces 30 automatically adapt to outer side surface 12 of cap C. During insertion of cap C into control ring 38, there is no risk of damaging cap C since jaws 28 are not pressed against cap C.

Retaining elements 46 only have the purpose of retaining cap C during the picking phase and they are not to transmit the screwing torque. Thus, retaining elements 46 are elastically biased inwards with a weak force that does not entail risks of damaging caps C. Moreover, the projecting portions of retaining elements 46 are rounded, so that they engage side wall 12 of cap C without risks of damaging the knurling of cap C.

After having picked up cap C, the capping chuck is positioned above a container, with axis A aligned with the axis of the container. Capping chuck 10 is actuated according to a helical movement in direction A. When the inner thread of cap C engages the outer thread of the container, head surface 14 of cap C comes into contact with abutment wall 42 of control ring 38. The screwing movement of capping chuck 10 makes cap C move control ring 38 upwards.

The upward movement of control ring 38 brings the first and second cam surfaces 32, 40 into mutual contact. By going on with the upward movement of control ring 38, mutually cooperating cam surfaces 32, 40 generate an inward-directed radial force onto jaws 28, which presses gripping surfaces 30 against outer side surface 12 of cap C. Jaws 28 are pressed against outer surface 12 of cap C with such a force as to ensure transmission of the screwing torque from chuck 10 to cap C. Radial compression of jaws 28 against outer side surface 12 of cap C takes place without any relative movement between jaws 28 and cap C, whereby risks of damaging cap C are prevented. The higher the force with which chuck 10 is pressed downwards, the greater the radial compression of jaws 28 against outer side surface 12 of cap C, so that the locking torque of cap C automatically increases as the vertical pressure increases. The vertical load closes jaws 28 and the rotation allows screwing, but it is not used for keeping jaws 28 closed. Thus, the closure of the chuck takes place even in the absence of the rotary movement, but only by effect of the vertical pressure to which the chuck is submitted.

At the end of the screwing phase, chuck 10 is raised from cap C screwed on the container. As soon as capping chuck 10 starts moving upwards, the force biasing control ring 38 upwards ceases. Therefore, control ring 38 moves to the lowered position because of its own weight. Hence, jaws 28 are radially free and disengage themselves from outer side surface 12 of cap C without exerting a compression on cap C. Also during the release phase, therefore, risks of damaging cap C are prevented.

A particularly advantageous feature is that capping chuck 10 according to the present invention does not require elastic elements for applying the screwing torque or for bringing jaws 28 back to the release position. In any case, the device could even be equipped with springs and elastic rings for ancillary functions with respect to the application of the closing force, such as for damping the re-opening phase, should this be necessary.

In this configuration, the absence of elastic elements reduces the risks of damaging cap C, increases the mean time between failures (MTBF) and makes washing more effective. Moreover, risks of stagnation of the washing liquid are avoided.

The capping chuck according to the present invention automatically adapts to the shape and size of caps C and is capable of picking up the caps without damaging them and of properly retaining them until the screwing phase. During screwing, chuck 10 transmits the screwing torque to the cap without damaging it and, at the end of the screwing, the jaws disengage themselves from the cap without damaging it.

The jaws for gripping the caps exploit the vertical load applied by the capping head, and closing mechanisms which can affect the reliability of the chuck are avoided. The jaws are self-adjusted to caps of different kinds, supplied by different manufacturers, made of different materials, having a different number of knurlings and having different shape and size tolerances.

The chuck according to the invention can be rotated both in clockwise direction and in counter-clockwise direction, since the gripping torque is independent of the direction of rotation. Moreover, the chuck according to the invention can be indifferently mounted either on a piston of a screwing head or on any other moving device, such as for instance an arm of robot or any other device capable of applying a vertical load sufficient for radially moving the jaws.

The capping chuck according to the present invention can also be equipped with a device for expelling the caps in case of failure of the cap screwing onto the containers.

Figure 6:
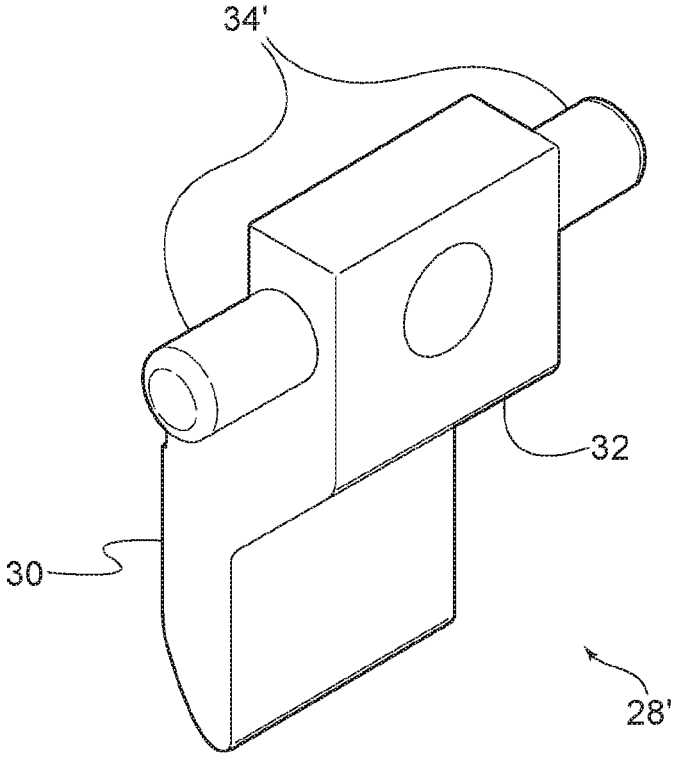
FIG. 6 is a perspective view of a jaw according to a variant embodiment.

Referring to FIG. 6, a variant embodiment 28' of the jaws engaging respective guides 26 of guide element 24 is shown. Jaws 28' are provided with respective pins 34' engaging respective tangential recesses 36 of guide element 24. In this variant embodiment, pins 34', instead of having a substantially square and axially tapered outwards cross-section, as shown for instance in FIG. 1, are cylindrical, with circular cross-section that preferably is substantial constant along the axis of symmetry. Said pins 34' preferably further have a fore end with bevelled peripheral edges. The cylindrical shape of pins 34', substantially without facets, helps the movements of jaws 28' in respective guides 26 during the phase of adapting chuck 10 to the top.

Of course, while leaving the principle of the invention unchanged, the construction details and the embodiments can be widely changed with respect to what has been described and shown, without thereby departing from the scope of the invention as defined by the following claims.

For instance, the shapes of the cam surfaces could be of different kinds, for instance plane, inclined, rounded, cylindrical, conical etc. Also the gripping surfaces for engaging caps C could have any shape, for instance cylindrical, conical, smooth, provided with one or more knurlings of different shapes, coated with any material or provided with any component for making torque transmission to the caps easier.

The invention claimed is:

1. A capping chuck for applying a closure element on a container, comprising:

a support (16) having a longitudinal axis (A), a guide element (24) fixed with respect to the support (16) and having a plurality of guides (26), and a plurality of jaws (28) which engage respective guides (26) of said guide element (24) and are movable with respect to the support (16) between a release position and a gripping position, wherein said jaws (28) have respective gripping surfaces (30) for gripping a closure element (C) and respective first cam surfaces (32), the chuck further comprising a control ring (38) provided as an outer ring relative to said jaws (28) and being movable relative to the support (16) along said longitudinal axis (A) between a lowered position and a raised position and having a plurality of second cam surfaces (40) cooperating with respective first cam surfaces (32) of said jaws (28), so that the movement of the control ring (38) from the lowered position to the raised position moves said jaws (28) from the release position to the gripping position, wherein the control ring (38) has an abutment wall (42) arranged to abut on a head surface (14) of the closure element (C) so that, during a movement of the chuck along said longitudinal axis (A), the closure element (C) moves the control ring (38) from the lowered position to the raised position.

2. The capping chuck according to claim 1, wherein said control ring (38) comprises a plurality of radial holes (44) within which respective retaining elements (46) are movable, which retaining elements are elastically biased inwards in a radial direction relative to the longitudinal axis and are adapted to engage an outer side surface (12) of the closure element (C) inserted into the control ring (38).

3. The capping chuck according to claim 1, wherein said guides (26) are formed by radial recesses which establish a guide coupling with respective jaws (28).

4. The capping chuck according to claim 1, wherein said jaws (28) are provided with pins (34) that engage respective tangential recesses (36) of said guide element (24).

5. The capping chuck according to claim 1, wherein movements of the control ring (38) from the lowered position to the raised position and thereby of the jaws (28) from the release position to the gripping position are caused solely by movements of the capping chuck along the longitudinal axis (A) relative to the closing element (C) and not by elastic elements, springs or elastic rings.

6. The capping chuck according to claim 5, further comprising an elastic element, spring, or elastic ring providing only an ancillary function to movement of said jaws (28) such that the elastic element, spring, or elastic ring is not responsible for causing the movement between the release and gripping positions.

7. The capping chuck according to claim 1, wherein movements of the control ring (38) from the raised position to the lowered position and the jaws (28) from the gripping position to the release position are caused by a force of gravity and not by elastic elements, springs, or elastic rings.

8. The capping chuck according to claim 7, wherein said guides are formed by radial recesses which establish a guide coupling with respective jaws.

9. The capping chuck according to claim 7, wherein said jaws are provided with pins that engage respective tangential recesses of said guide element.

10. A capping chuck for applying a closure element on a container, comprising:

a support having a longitudinal axis;

a guide element fixed with respect to the support and having a plurality of guides; and a plurality of jaws which engage respective guides of said guide element and are movable with respect to the support between a release position and a gripping position, wherein said jaws have respective gripping surfaces for gripping a closure element and respective first cam surfaces;

the chuck further comprising a control ring movable relative to the support along said longitudinal axis between a lowered position and a raised position and having a plurality of second cam surfaces cooperating with respective first cam surfaces of said jaws, so that the movement of the control ring from the lowered position to the raised position moves said jaws from the release position to the gripping position, wherein the control ring has an abutment wall arranged to abut on a head surface of the closure element so that, during a movement of the chuck along said longitudinal axis, the closure element moves the control ring from the lowered position to the raised position;

wherein said control ring comprises a plurality of radial holes within which respective retaining elements are movable, which retaining elements are elastically biased inwards in a radial direction relative to the longitudinal axis and are adapted to engage an outer side surface of the closure element inserted into the control ring.

* * * * *